US009920639B2

(12) United States Patent
Sekihara et al.

(10) Patent No.: US 9,920,639 B2
(45) Date of Patent: Mar. 20, 2018

(54) GAS TURBINE COMBUSTION CHAMBER HAVING A FLOW SLEEVE WITH A PLURALITY OF INTEGRATED SEGMENTS

(71) Applicant: Mitsubishi Hitachi Power Systems, Ltd., Yokohama (JP)

(72) Inventors: Masaru Sekihara, Tokyo (JP); Kunihiro Ichikawa, Tokyo (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 235 days.

(21) Appl. No.: 14/079,920

(22) Filed: Nov. 14, 2013

(65) Prior Publication Data

US 2014/0150453 A1 Jun. 5, 2014

(30) Foreign Application Priority Data

Nov. 30, 2012 (JP) ..... 2012-261840

(51) Int. Cl.
*F01D 9/02* (2006.01)
*F23R 3/60* (2006.01)

(52) U.S. Cl.
CPC ..... *F01D 9/023* (2013.01); *F23R 3/60* (2013.01); *F23R 2900/00005* (2013.01)

(58) Field of Classification Search
CPC ..... F01D 9/023; F23R 3/60
See application file for complete search history.

(56) References Cited

U.S. PATENT DOCUMENTS 2,999,704 A * 9/1961 Haller ..... F16D 1/0829 384/202
2007/0251240 A1 11/2007 Johnson et al.
2010/0154436 A1 1/2010 Johnson et al.

FOREIGN PATENT DOCUMENTS

JP 02004037035 A * 2/2004 ..... F23R 3/42
JP 2007-285692 A 11/2007

OTHER PUBLICATIONS

English Translation of JP02004037035A (Description and Claims).*

* cited by examiner

*Primary Examiner* — Gerald L Sung
*Assistant Examiner* — Scott Walthour
(74) *Attorney, Agent, or Firm* — Crowell & Moring LLP

(57) ABSTRACT

A gas turbine combustion chamber is provided, including a flow sleeve structure with an improved anti-vibration performance. A gas turbine combustion chamber of the present invention includes a liner, a transition piece, and a flow sleeve including a plurality of segments and integrated by welding a tie piece along joint portions of the segments. The tie piece includes a first member and a second member, the first member continuously extending along a longitudinal direction of the joint portions of the segments and being arranged to cover the joint portions, and the second member being formed at an end portion of the first member, having a width wider than the first member, and including a recess.

5 Claims, 6 Drawing Sheets

PRIOR ART

GAS TURBINE COMBUSTION CHAMBER HAVING A FLOW SLEEVE WITH A PLURALITY OF INTEGRATED SEGMENTS

CLAIM OF PRIORITY

The present application claims priority from Japanese Patent Application JP 2012-261840 filed on Nov. 30, 2012, the content of which is hereby incorporated by reference into this application.

FIELD OF THE INVENTION

The present invention relates to a combustion chamber that is a constituent element of a gas turbine and, particularly, relates to a flow sleeve structure housing a transition piece therein.

BACKGROUND OF THE INVENTION

A transition piece, which is a component of a gas turbine combustion chamber, generally has a shape that connects a cylindrical liner and a turbine passage that is an annular passage. Moreover, a flow sleeve is arranged around the transition piece to form a passage for inducing discharged air from a compressor to the liner between an outer surface of the transition piece and the flow sleeve.

This flow sleeve has a structure to house the complex transition piece, so that it often employs a structure in which a tie piece is welded to joint faces of half-section structures to join the half-section structures together. Moreover, in the combustion chamber of the gas turbine, a small vibration may be involved at the time of combustion. Therefore, it is desirable to optimize the shape of the tie piece because fatigue damage may be produced at a welded portion due to the vibration. Examples of the tie piece structure generally include a band-plate-shaped tie piece having a recess at the end portion thereof that is irregularly different in the width as is disclosed in JP 2007-285692, and a rectangular-plate-shaped tie piece which has a recess separately provided.

However, it is conceivable that the technique in JP 2007-285692 needs a more effective anti-vibration structure because the structure disclosed in JP 2007-285692 may be insufficient when future increases in the pressure ratio and output are taken into consideration.

The object of the present invention is to provide a gas turbine combustion chamber including a flow sleeve structure with an improved anti-vibration performance.

SUMMARY OF THE INVENTION

In order to attain the above-mentioned object, a gas turbine combustion chamber according to the present invention includes a liner, a transition piece, and a flow sleeve including a plurality of segments and integrated by welding a tie piece along joint portions of the segments. The tie piece includes a first member and a second member, the first member continuously extending along a longitudinal direction of the joint portions of the segments and being arranged to cover the joint portions, and the second member being formed at an end portion of the first member, having a width wider than the first member, and including a recess.

According to the present invention, it is possible to provide a gas turbine combustion chamber including a flow sleeve structure with an improved anti-vibration performance.

DETAILED DESCRIPTION OF THE PREFERRED EMBODIMENTS

Figure 1:
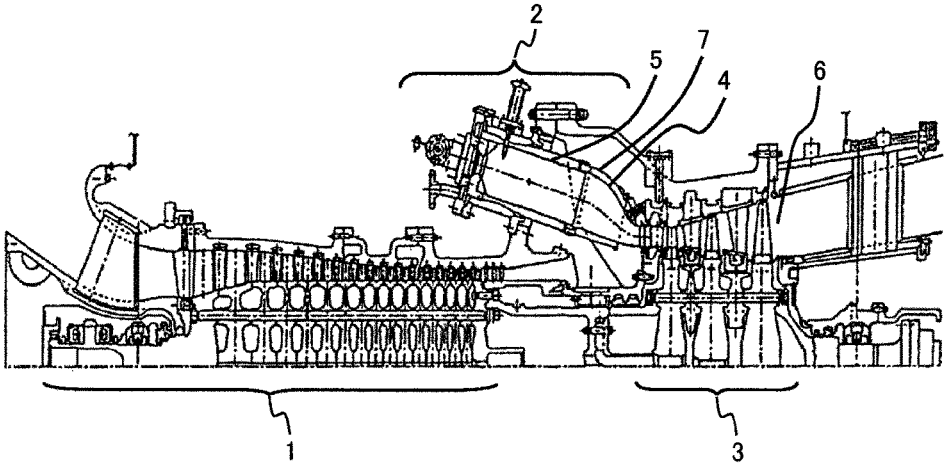
FIG. 1 is a view showing an example of an entire structure of a general gas turbine.

FIG. 1 is a structural sectional view of a general gas turbine. The gas turbine primarily includes a compressor 1, a combustion chamber 2, and a turbine 3. The compressor 1 sucks in air from the atmosphere and adiabatically compresses the air as operating fluid. The combustion chamber 2 mixes fuel into the compressed air supplied from the compressor 1, and combusts the mixture and produces high-temperature and high-pressure gas. The turbine 3 then produces rotational power at the time of expansion of the combusted gas introduced from the combustion chamber 2. Exhaust gas from the turbine 3 is discharged into the atmosphere.

In particular, a transition piece 4, which is a component of the combustion chamber 2, has a shape connecting a cylindrical liner 5 and a tubular turbine passage 6. The liner 5 forms a combustion room and the transition piece 4 is connected to a downstream side of the liner 5 as viewed from a flow direction of the combusted gas. In addition, a flow sleeve 7 is provided on an outer side of the transition piece 4. The flow sleeve 7 houses the transition piece 4 and is arranged at a predetermined interval from the transition piece 4. The compressed air discharged from the compressor 1 is introduced to an inlet side of the liner 5 through a passage which is formed by the interval between the flow sleeve 7 and the transition piece 4.

Figure 2:
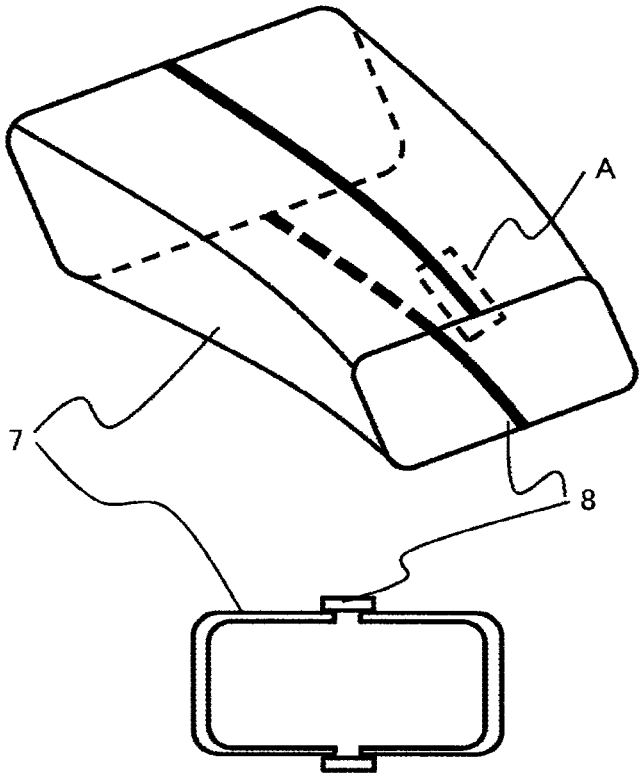
FIG. 2 is a view showing a structure in which a tie piece is welded to joint faces of a half-divided flow sleeve.
Figure 3:
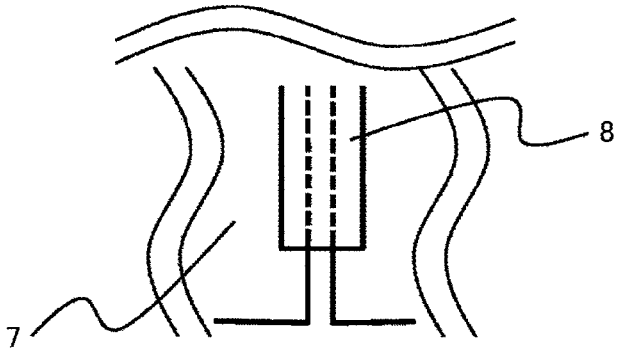
FIG. 3 is an enlarged view of a portion A in FIG. 2.

FIG. 2 is a view showing a structure example of the flow sleeve 7 shown in FIG. 1. FIG. 3 is an enlarged view of a portion A in FIG. 2 and a view showing an end-portion structure of a tie piece 8. The flow sleeve 7 includes a plurality of segments (half segments in the example in FIG. 2). It is generally known to weld the tie piece 8 along the joint portions of the segments to thereby integrate the flow sleeve 7.

Based on the above-described flow sleeve structure (comparative example) of the combustion chamber, embodiments of the present invention will be explained hereinafter with reference to the drawings.

Figure 4:
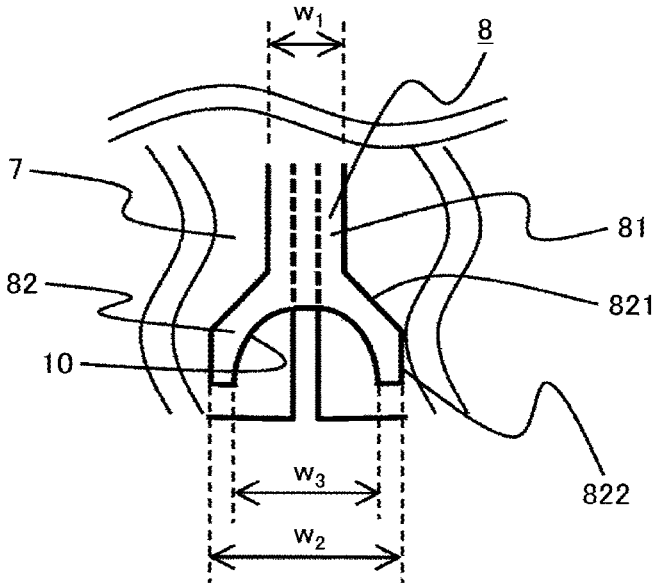
PRIOR ART FIG. 4
FIG. 4 is a view showing a flow sleeve structure according to the first embodiment of the present invention.

FIG. 4 is a view showing a flow sleeve structure according to the first embodiment of the present invention. As shown in FIG. 4, the flow sleeve 7 employs a structure formed by welding a tie piece 8 to the joint faces of the half segment structures. The tie piece 8 according to this embodiment includes a first member 81 and second member 82. The first member 81 continuously extends along the longitudinal direction of the joint portions of the segments and is arranged to cover the joint portions. The second member 82 is formed at the end portion of the first member 81 and has a width wider than the first member 81. The second member 82 includes a semicircle-shaped recess 10 that does not cover the joint portions of the flow sleeve 7. The second member 82 has surfaces 821 inclined with respect to the joint faces of the half segments of the flow sleeve 7, and has surfaces 822 parallel to the joint faces. When a width of the first member 81 of the tie piece 8 is denoted by W1, a width of the second member 82 of the tie piece 8 is denoted by W2, and a width (opening width) of the recess 10 in the end portion of the second member 82 is denoted by W3, a relationship W1<W3<W2 is obtained. This structure makes the second member 82 a low rigid portion owing to the presence of the recess 10 when the entire tie piece 8 is considered.

In this way, it is possible to improve the rigidity by increasing the length of the welded portion of the tie piece 8, and suppress the displacement-control-type stress due to thermal-expansion deformation produced by the housed transition piece 4 on the high temperature side by reducing the rigidity owing to the recess 10.

Figure 5:
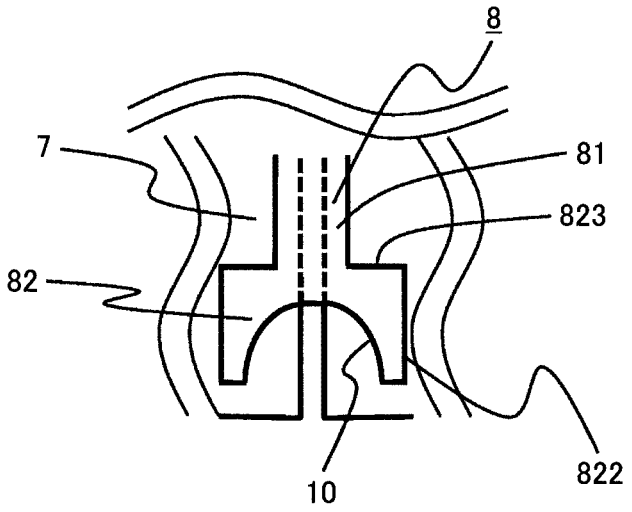
FIG. 5 is a view showing a flow sleeve structure according to the second embodiment of the present invention.

FIG. 5 is a view showing a flow sleeve structure according to the second embodiment of the present invention. As shown in FIG. 5, a tie piece 8 according to this embodiment includes a second member 82 that is formed to have surfaces 823 perpendicular to the joint faces of the half segments and surfaces 822 parallel to the joint faces. In this way, it is possible to improve the rigidity by increasing the length of the welded portion of the tie piece 8, and suppress the displacement-control-type stress due to thermal-expansion deformation produced by the housed transition piece 4 on the high temperature side by reducing the rigidity owing to the recess 10.

Figure 6:
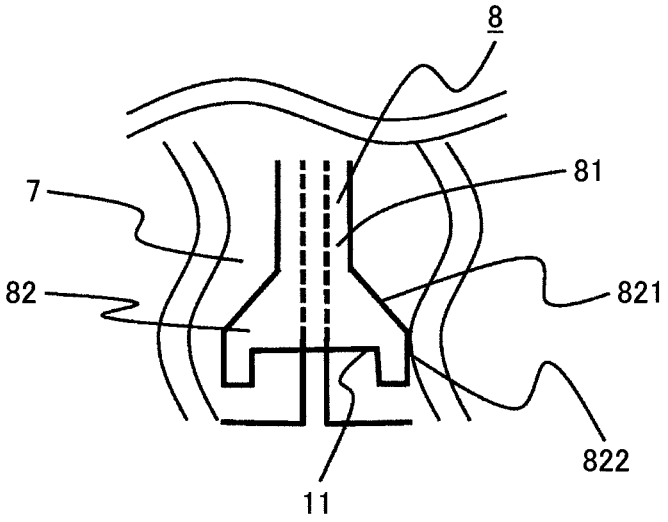
FIG. 6 is a view showing a flow sleeve structure according to the third embodiment of the present invention.

FIG. 6 is a view showing a flow sleeve structure according to the third embodiment of the present invention. While the recess 10 shown in FIG. 4 has a semicircle shape, a recess 11 is formed in a rectangular shape in this embodiment. In this way, it is possible to improve the rigidity by increasing the length of the welded portion of the tie piece 8, and suppress the displacement-control-type stress due to thermal-expansion deformation produced by the housed transition piece 4 on the high temperature side by reducing the rigidity owing to the recess 11.

Figure 7:
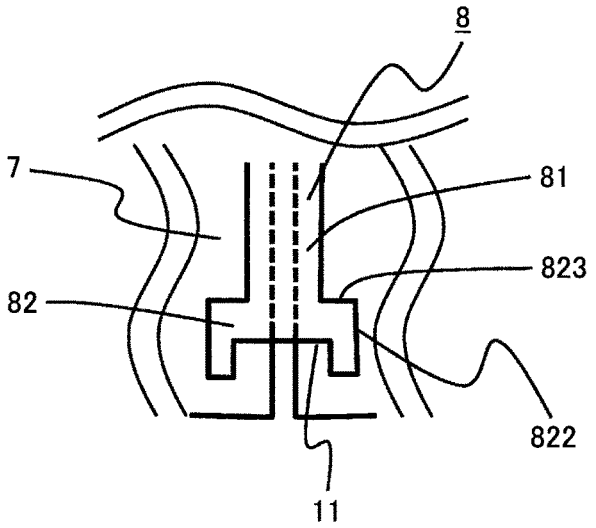
FIG. 7 is a view showing a flow sleeve structure according to the fourth embodiment of the present invention.

FIG. 7 is a view showing a flow sleeve structure according to the fourth embodiment of the present invention. While the recess 10 shown in FIG. 5 has a semicircle-shape, the recess 11 is formed in a rectangular shape in this embodiment. In this way, it is possible to improve the rigidity by increasing the length of the welded portion of the tie piece 8, and suppress the displacement-control-type stress due to thermal-expansion deformation produced by the housed transition piece 4 on the high temperature side by reducing the rigidity owing to the recess 11.

Figure 8:
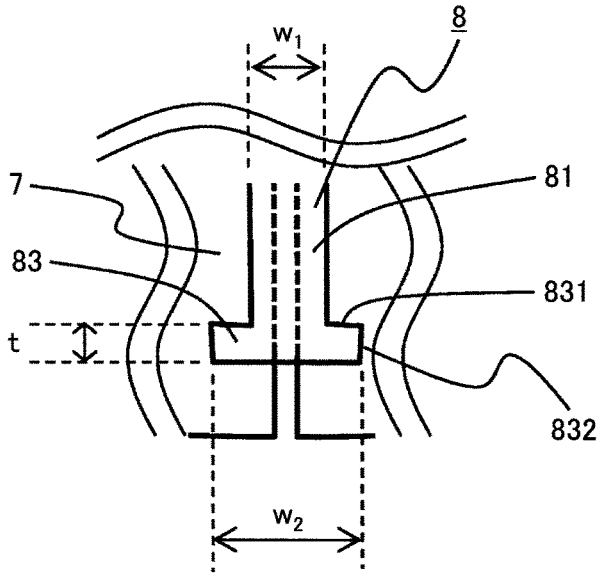
FIG. 8 is a view showing a flow sleeve structure according to the fifth embodiment of the present invention.

FIG. 8 is a view showing a flow sleeve structure according to the fifth embodiment of the present invention. In this embodiment, a T-shaped third member 83 is provided at the end portion of the first member 81 instead of the second member 82, while the second members 82 including the recess 10 or 11 at the end portions thereof are provided in the first to forth embodiments, as shown in FIGS. 4-7. Specifically, the third member 83 has the width W2 wider than the width W1 of the first member 81, and has the length t measured in a longitudinal direction of the tie piece 8 shorter than W1. A relationship among these sizes is expressed by t<W1<W2. The third member 83 has surfaces 831 perpendicular to the joint faces of the half segments, and has surfaces 832 parallel to the joint faces. In this way, it is possible to improve the rigidity by increasing the length of the welded portion of the tie piece 8.

Figure 9:
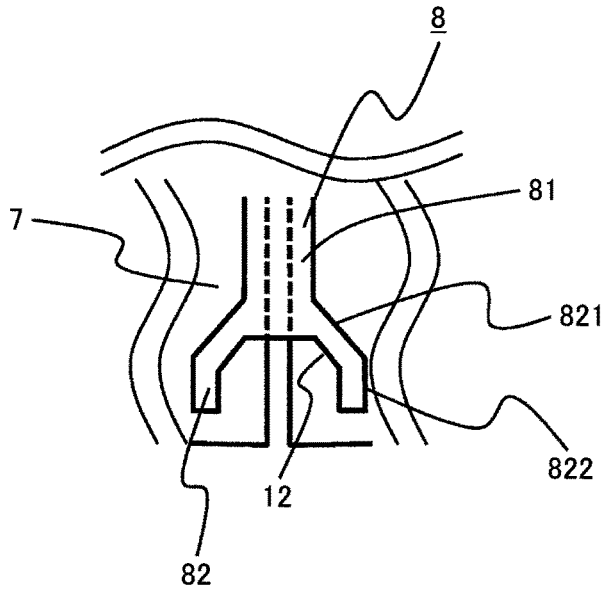
FIG. 9 is a view showing a flow sleeve structure according to the sixth embodiment of the present invention.

FIG. 9 is a view showing a flow sleeve structure according to the sixth embodiment of the present invention. While the tie piece 8 shown in FIG. 4 includes the recess 10 having a semicircle-shape, the tie piece 8 in this embodiment includes a recess 12 formed by a combination of surfaces perpendicular to the joint faces of the half segments, surfaces inclined with respect to the joint faces, and surfaces parallel to the joint faces. In this way, it is possible to improve the rigidity by increasing the length of the welded portion of the tie piece 8, and suppress the displacement-control-type stress due to thermal-expansion deformation produced by the housed transition piece 4 on the high temperature side by reducing the rigidity owing to the recess 12.

Figure 10:
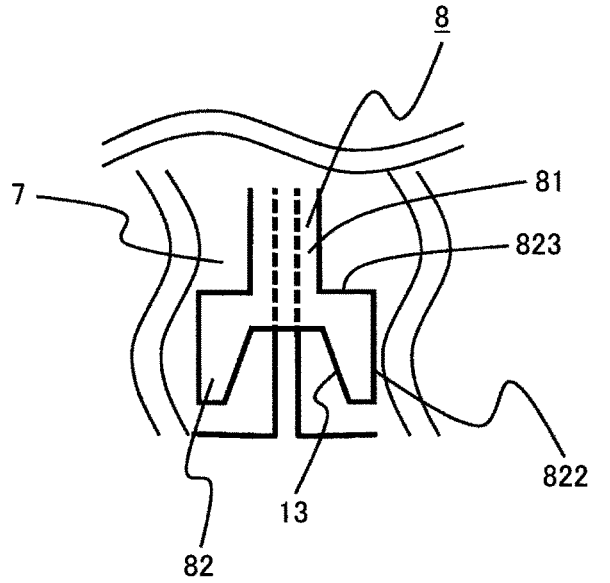
FIG. 10 is a view showing a flow sleeve structure according to the seventh embodiment of the present invention.

FIG. 10 is a view showing a flow sleeve structure according to the seventh embodiment of the present invention. While the tie piece 8 shown in FIG. 5 includes the recess 10 having a semicircle-shape, the tie piece 8 in this embodiment includes a recess 13 formed by a combination of surfaces perpendicular to the joint faces of the half segments and surfaces inclined with respect to the joint faces. In this way, it is possible to improve the rigidity by increasing the length of the welded portion of the tie piece 8, and suppress the displacement-control-type stress due to thermal-expansion deformation produced by the housed transition piece 4 on the high temperature side by reducing the rigidity owing to the recess 13.

What is claimed is:

1. A gas turbine combustion chamber comprising:

a liner forming a combustion zone;

a transition piece connected to a downstream side of the liner; and a flow sleeve including a plurality of segments, the flow sleeve housing the transition piece, and the plurality of segments being integrated with each other by welding a tie piece along each of a plurality of joint portions of the plurality of segments, wherein each of the tie pieces includes a first member and a second member, the first member continuously extending along a longitudinal direction of one of the plurality of joint portions of the plurality of segments and being arranged to cover the one of the plurality of joint portions, the second member being formed at an end portion of the first member, the second member having a width wider than a width of the first member, and the second member including a recess;

wherein a width of the recess at an end portion of the second member is wider than the width of the first member;

wherein the width of the first member is denoted by W1, the width of the second member is denoted by W2, the width of the recess at the end portion of the second member is denoted by W3, and a relationship between W1, W2, and W3 is W1<W3<W2;

wherein the second member includes first outer side surfaces, all of which are inclined at a same acute angle with respect to joint faces of the plurality of segments, and second outer side surfaces parallel to the joint faces;

wherein the first outer side surfaces and the second outer side surfaces are outermost side surfaces of the second member, with respect to the joint faces, in a width direction along width W2;

wherein each of the first outer side surfaces is connected to a respective outermost side surface of the first member, with respect to the joint faces in a width direction along width W1; and wherein each of the first outer side surfaces is connected to a respective one of the second outer side surfaces.

2. The gas turbine combustion chamber according to claim 1, wherein the recess is semicircular in shape.

3. The gas turbine combustion chamber according to claim 1, wherein the recess is rectangular in shape.

4. The gas turbine combustion chamber according to claim 1, wherein the recess is formed by a combination of at least surfaces perpendicular to the joint faces of the plurality of segments and surfaces inclined with respect to the joint faces of the plurality of segments.

5. The gas turbine combustion chamber according to claim 1, wherein the first outer side surfaces and the second outer side surfaces are disposed adjacent to the recess.

* * * * *